United States Patent [19]

Bradbury

[11] Patent Number: 4,676,548

[45] Date of Patent: Jun. 30, 1987

[54] KNAPSACK AND FRAME CONVERTIBLE TO A FOLDING CHAIR

[76] Inventor: Patrick H. Bradbury, 17518 Strathern, Northridge, Calif. 91325

[21] Appl. No.: 860,785

[22] Filed: May 8, 1986

[51] Int. Cl.[4] ..... A45F 4/02

[52] U.S. Cl. ..... 297/129; 224/155; 297/17; 297/39; 297/191

[58] Field of Search ..... 297/39, 118, 129, 191, 297/17; 224/155

[56] References Cited

U.S. PATENT DOCUMENTS

| | | | |
|---|---|---|---|
| 4,300,707 | 11/1981 | Kjaer | 297/129 X |
| 4,487,345 | 12/1984 | Pierce et al. | 224/155 |
| 4,489,866 | 12/1984 | Korte | 224/155 |

FOREIGN PATENT DOCUMENTS

| | | | |
|---|---|---|---|
| 1194851 | 6/1970 | United Kingdom | 224/155 |
| 1469054 | 3/1977 | United Kingdom | 297/118 |
| 2128471 | 5/1984 | United Kingdom | 224/155 |

*Primary Examiner*—Kenneth I. Dorner
*Assistant Examiner*—Peter R. Brown
*Attorney, Agent, or Firm*—Rapkin, Gitlin & Moser

[57] ABSTRACT

The present invention in its preferred embodiment comprises a combination pack and frame, which is convertible to a chair. The frame includes a generally rectangular shaped back section fixedly connected to the pack and a generally rectangular seat section that is indirectly connected to the pack and pivotally connected to the back section. The back and seat sections contain back and seat support panels, respectively, that are integrally formed with the material of which the pack is constructed. Each of two adjustable shoulder straps is attached at one of its ends to the front portion of the seat section and at its opposite end to the bottom portion of the pack and which, in the chair mode, wrap around the chair legs to give the legs added support.

7 Claims, 3 Drawing Figures

KNAPSACK AND FRAME CONVERTIBLE TO A FOLDING CHAIR

BACKGROUND OF THE INVENTION

1. Field of the Invention

This invention relates to a device for use in conjuction with backpacking, sporting and entertainment activities and more particularly, to a combination knapsack and pack frame that is easily convertible to a chair and then back again to a pack and frame.

2. Description of the Prior Art

Originally, it is believed that backpacks were carried without frames or any other loan bearing or distribution apparatus aside from shoulder and waist straps and the like. As backpacks evolved in design, frames were introduced to help distribute the load carried in the pack. The frame also helped to make the experience of carrying the pack a much more comfortable and enjoyable one, especially over long distances. Combination packs and frames ultimately developed to meet the greater needs of the user. In this regard, these combinations were designed to be convertible to a variety of furniture items, such as chairs and stools. For example, see the devices disclosed in U.S. Pat. Nos. 3,662,932; 4,387,924; and 4,450,990.

The devices of the prior art that convert to a chair or stool usually contain a multiplicity of parts, have little or no back support in the chair position or require some degree of assembly to convert the pack to the seating unit. Where a device of the prior art does not contain these drawbacks, it will nevertheless not include one of the more significant elements of the present invention, namely the integration of the material forming the pack with the chair back and seat support panels. In short, the device of the present invention solves essentially all of the problems associated with the devices of the prior art.

The present invention includes a combination pack and frame, which is convertible to a chair. The pack includes a plurality of storage compartments and is formed from any resilient and sturdy material, such as canvass. The frame includes a generally rectangular shaped back section fixedly connected to the pack and a generally rectangular seat section that is indirectly connected to the pack and pivotally connected to the back section. The back and seat sections contain back and seat support panels, respectively, that are integrally formed with the material of which the pack is constructed. Attached to the seat section are U-shaped first and second leg members, each of which is pivotally connected to the seat section at the forward and the approximate mid-sectional positions thereof. Armrests are pivotally connected to the respective end portions of the first and second leg members and each of the side tubular members of the frame's back section. Each of two adjustable shoulder straps is attached at one of its ends to the front portion of the seat section and at its opposite end to the bottom portion of the pack.

The resilient pack material located along the perimeter of and formed integrally with the pack is wrapped or folded around and fixedly secured to the side and top tubular members of the back section and the front tubular members. This material is also wrapped or folded around and fixedly secured to the side and front tubular members of the seat section. A pair of straps, one end of which is attached to the top portion of the pack and the other which is attached to the front portion of the seat section, are coupled when the device of the present invention is in pack position and uncoupled to permit the frame section to unfold to convert to a chair.

The advantages and distinctions of the present invention over the prior art will become clearly evident in the following disclosure.

SUMMARY OF THE INVENTION

The present invention in its preferred embodiment comprises a combination pack and frame, which is convertible to a chair. The pack includes a plurality of storage compartments and is formed from any resilient and sturdy material, such as canvass. The frame includes a generally rectangular shaped back section fixedly connected to the pack and a generally rectangular seat section that is indirectly connected to the pack and pivotally connected to the back section. The back and seat sections contain back and seat support panels, respectively, that are integrally formed with the material of which the pack is constructed. Attached to the seat section are U-shaped first and second leg members, each of which is pivotally connected to the seat section at the forward and the approximate mid-sectional position thereof. Armrests are pivotally connected to the respective end portions of the first and second leg members and each of the side tubular members of the frame's back section. Each of two adjustable shoulder straps is attached at one of its ends to the front portion of the seat section and at its opposite end to the bottom portion of the pack.

The resilient pack material located along the perimeter of and formed integrally with the pack is wrapped or folded around and fixedly secured to the side and top members of the back section and the side and front tubular members. This material is also wrapped or folded around and fixedly secured to the side and front tubular members of the seat section. A pair of straps, one end of which is attached to the top portion of the pack and the other which is attached to the front portion of the seat section, are coupled when the device of the present invention is in pack position and uncoupled to permit the frame section to unfold to convert to a chair.

The primary object of the present invention is to provide a combination pack and convertible chair wherein the material comprising the pack is formed integrally with the chair back and seat support panels.

Another object of the present invention is to provide a combination pack and convertible chair wherein the back support panel also serves as the back section of the pack within which a variety items may be stored and carried by the user.

Another object of the present invention is to provide a combination pack and convertible chair wherein the material of which the pack is constructed is utilized to affix the pack to the frame to further enhance the integrity and strength of the combination device.

Still another object of the present invention is to provide a combination pack and convertible chair that is easy to use and inexpensive to manufacture.

Yet still another object of the present invention is to provide a combination pack and convertible chair that is light weight and rugged in construction.

Yet still another object of the present invention is to provide a combination pack and convertible chair that is comfortable for the wearer to carry for short or long distances.

Yet still another object of the present invention is to provide a combination pack and convertible chair which includes shoulder straps that are adaptable when the invention is in the chair mode for wrapping and securing tightly around the chair legs to give the legs added support when straining under excessive weight.

Other objects and advantages will become apparent in the following specification when considered in light of the attached drawings wherein a preferred embodiment of the invention is illustrated.

DETAILED DESCRIPTION OF THE PREFERRED EMBODIMENT

Figure 1:
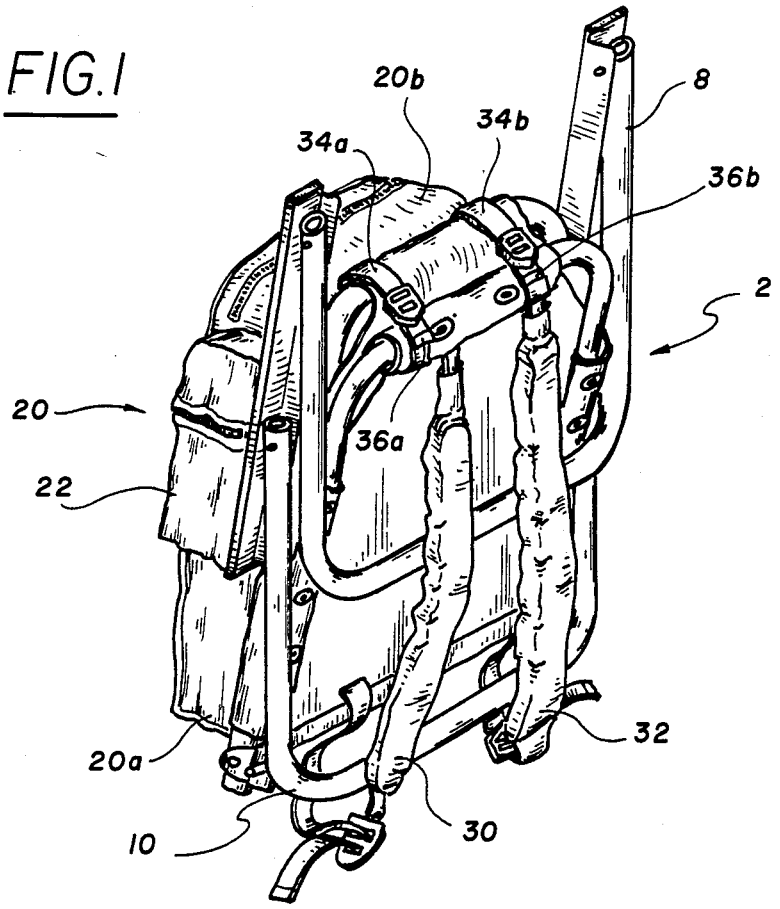
FIG. 1 is the combination pack and convertible chair of the present invention shown in the pack state.
Figure 2:
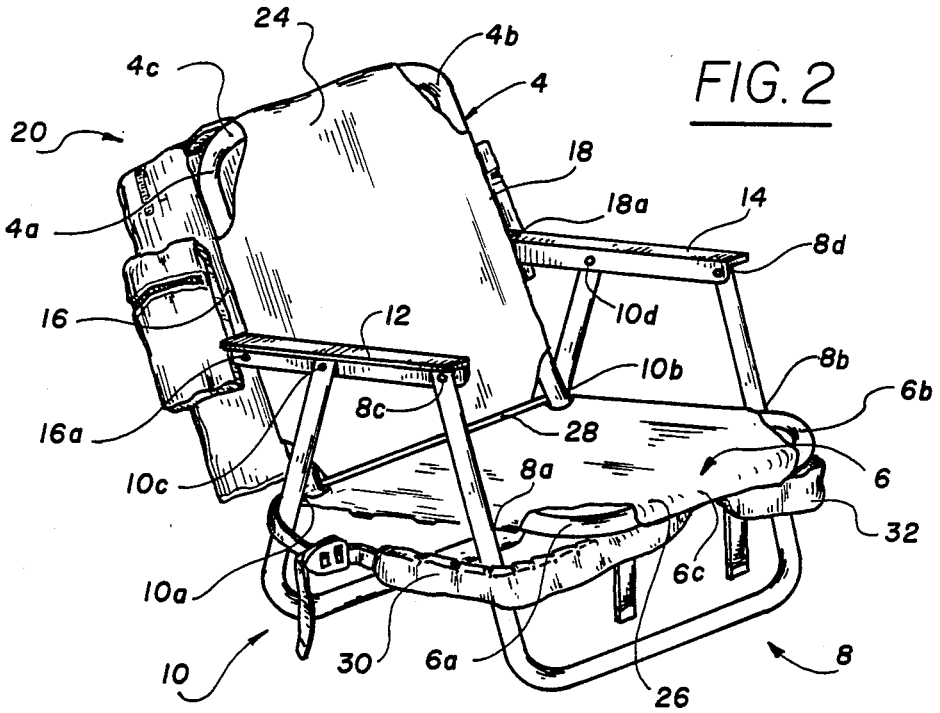
FIG. 2 is the combination pack and convertible chair of the present invention shown in the chair state.

Referring now in greater detail to the device of the present invention and with particular reference to the embodiment illustrated in the drawings, frame 2 may be constructed of any light weight metal alloy or plastic and is comprised of straight and curved tubular members that form generally rectangular shaped back and seat sections 4 and 6 that are pivotally connected to each other. Attached to seat section 6 are U-shaped leg members 8 and 10 each of which is pivotally connected to seat section 6 at positions 8*a*, 8*b* and 10*a*, 10*b*, respectively. Armrests 12 and 14 are pivotally connected to end positions 8*c*, 8*d* and 10*c*, 10*d* of leg members 8 and 10 and back section side members 16 and 18 at approximate midsectional positions 16*a* and 18*a*, respectively.

Pack 20 may be constructed of any sturdy and resilient material, such as canvass, and contains a plurality of storage compartments, such as, for example, compartment 22. The material forming pack 20 is used to attach pack 20 to frame 2. The material is wrapped around tubular members 4*a*, 4*b* and 4*c* of back section 4 and affixed thereto by any known conventional means. Formed integrally with said material are tautly drawn back support panel 24 and seat support panel 26, which are attached to tubular members 6*a*, 6*b* and 6*c* using the same means as heretofore described. Rod 28 connects the ends of tubular members 4*a* and 4*b* to enhance the integrity of said back section and assist to maintain the tautness of support panels 24 and 26.

Figure 3:
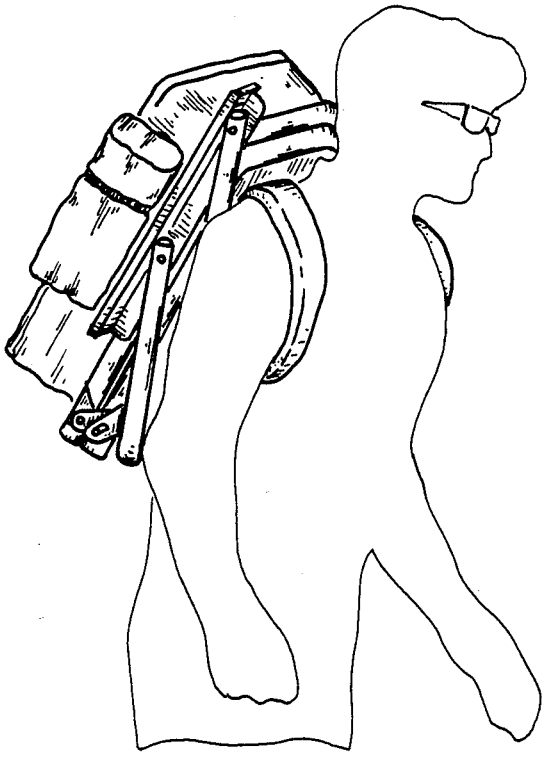
FIG. 3 is the combination pack and convertible chair of the present invention shown being worn and carried by a person.

Adjustable shoulder straps 30 and 32 are attached at one end thereof to tubular member 6*c* and at the other end thereof to bottom section 20*a* of pack 20. When the present invention is in the chair mode, straps 30 and 32 may be brought to the sides and secured tightly around the respective upright portions of leg members 8 and 10 to give added support to the chair frame which is otherwise likely to strain under the combined weight of the person sitting in it and the contents of pack 20. Straps 34*a* and 34*b* are connected to the edge of top section 20*b* of pack 20. Straps 36*a* and 36*b* are connected to tubular member 6*c*. In pack position, as shown in FIGS. 1 and 3, straps 34*a*, 36*a* and 34*b*, 36*b* are brought together and attached by any known conventional coupling means. Straps 34*a*, 36*a* and 34*b*, 36*b* are disengaged when it is desirable to unfold frame 2 to convert it to chair 38.

While the invention will be described in connection with a certain preferred embodiment it is to be understood that it is not intended to limit the invention to that particular embodiment. Rather, it is intended to cover all alternatives, modifications and equivalents as may be included within the spirit and scope of the invention as defined by the appended claims.

I claim:

1. A combination knapsack and frame convertible to a chair comprising:

(a) a pack including top and bottom portions and comprising one or more storage compartments;

(b) a first means integrally formed with said pack for attachment thereof to said frame;

(c) a second means for attachment of said pack to said frame in pack position;

(d) a folding chair portion comprising:

(i) a chair back frame fixedly connected to said pack, said back frame including front, back and first and second side members, (ii) a chair seat frame pivotally connected to said chair back frame, said seat frame including a front portion, first and second side members, and U-shaped first and second leg members pivotally connected to said seat frame at the respective forward position and approximate mid-section thereof, (iii) a pair of armrests each of which is pivotally connected to the respective ends of said first and second leg members and first and second side members of said chair back frame, (iv) a back support panel incorporated within the area defined by said front, back and first and second side members and integrally formed with said pack, and (v) a seat support panel incorporated within the area defined by said front and first and second side members and integrally formed with said pack, and (e) a pair of adjustable shoulder straps, one end of each being directly attached to said front member of said chair seat frame and the other end of each being directly attached to the bottom portion of said pack, such that when the knapsack is converted to a chair the straps are wrapped around the corresponding sides of said first and second leg members and drawn increasingly taught to provide additional support to the chair frame.

2. The invention according to claim 1 wherein said seat support panel is affixed to said chair seat frame.

3. The invention according to claim 1 wherein said back support panel is affixed to said chair back frame.

4. The invention according to claim 1 wherein said first attachment means comprises the means for constructing said pack being folded over and affixed to the side members and top portion of said chair back frame and the side members and forward portion of said chair seat frame.

5. The invention according to claim 4 wherein said chair back frame defines a tautly drawn back support panel.

6. The invention according to claim 4 wherein said chair seat frame defines a tautly drawn seat support panel.

7. The invention according to claim 1 wherein said second means for attachment includes a first and second set of strap members each of which contains a first member that is affixed in spaced apart relation to said top portion of said pack and corresponding first and second mate members attached to the front portion of said chair seat frame.

* * * * *